US008020421B2

(12) United States Patent
Yamakawa et al.

(10) Patent No.: US 8,020,421 B2
(45) Date of Patent: Sep. 20, 2011

(54) PUSHER DEVICE FOR PIERCING AND ROLLING AND METHOD OF MANUFACTURING SEAMLESS PIPE OR TUBE USING THE SAME

(75) Inventors: Tomio Yamakawa, Osaka (JP); Kazuhiro Shimoda, Osaka (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 97 days.

(21) Appl. No.: 12/685,869

(22) Filed: Jan. 12, 2010

(65) Prior Publication Data

US 2010/0107714 A1 May 6, 2010

Related U.S. Application Data

(63) Continuation of application No. PCT/JP2008/052826, filed on Feb. 20, 2008.

(30) Foreign Application Priority Data

Jul. 13, 2007 (JP) ..... 2007-184901

(51) Int. Cl.
*B21B 19/04* (2006.01)

(52) U.S. Cl. ..... 72/97; 72/7.1; 72/365.2

(58) Field of Classification Search ..... 72/7.1, 72/96, 97, 208, 209, 365.2, 366.2
See application file for complete search history.

(56) References Cited

U.S. PATENT DOCUMENTS

| | | | | |
|---|---|---|---|---|
| 1,843,395 | A * | 2/1932 | Lauterbach | 72/97 |
| 7,739,892 | B2 * | 6/2010 | Yamakawa et al. | 72/97 |
| 7,757,528 | B2 * | 7/2010 | Yamakawa et al. | 72/97 |

FOREIGN PATENT DOCUMENTS

| | | | |
|---|---|---|---|
| JP | 56-12501 | | 2/1981 |
| JP | 59-4909 | * | 1/1984 |
| JP | 4-135002 | * | 5/1992 |
| JP | 2000-246311 | | 9/2000 |
| JP | 2001-162306 | | 6/2001 |
| WO | 2007/100042 | * | 9/2007 |

* cited by examiner

*Primary Examiner* — Edward Tolan
(74) *Attorney, Agent, or Firm* — Clark & Brody

(57) ABSTRACT

A pusher device 4 includes a cylinder device 30 and a pusher mandrel 34. The cylinder device 30 includes a cylinder shaft 32. The pusher mandrel 34 is attached to the tip end of the cylinder shaft 32. The tip end of the pusher mandrel 34 is abutted against the rear end of a billet 20. The cross sectional area Sp of the pusher mandrel 34 and the cross sectional area Sb of the billet 20 satisfy Expression (1). The length Lp of the pusher mandrel 34 and the cross sectional area Sp of the pusher mandrel 34 satisfy Expression (2). The moving distance Lc of the tip end of the cylinder shaft 32 during piercing and rolling and the outer diameter Dc of the cylinder shaft 32 satisfy Expression (3). Therefore, the pusher device 4 can restrain the wall thickness deviation of the tip end part of a produced hollow shell.

$$0.3 \leqq Sp/Sb \quad (1)$$

$$Lp/Sp \leqq 1.2 \quad (2)$$

$$Lc/Dc \leqq 45 \quad (3)$$

4 Claims, 6 Drawing Sheets

PUSHER DEVICE FOR PIERCING AND ROLLING AND METHOD OF MANUFACTURING SEAMLESS PIPE OR TUBE USING THE SAME

This application is a continuation of International Patent Application No. PCT/JP2008/052826, filed Feb. 20, 2008. This PCT application was not in English as published under PCT Article 21(2).

TECHNICAL FIELD

The present invention relates to a pusher device and a method of manufacturing a seamless pipe or tube using the same, and more specifically, to a pusher device for piercing and rolling used for making a billet into a hollow shell by piercing and rolling the billet, and a method of manufacturing a seamless pipe or tube using the same.

BACKGROUND ART

A seamless pipe or tube is produced by piercing and rolling a solid round billet by a piercing mill. The piercing mill includes a plurality of inclined rolls and a plug is provided between the plurality of inclined rolls. A pusher device is provided on the inlet side of the piercing mill.

A billet heated in a heating furnace has its rear end pushed by the pusher device and is transported toward between the inclined rolls. When the billet is bitten between the inclined rolls, the pusher stops pushing the billet. The billet engaged between the inclined rolls is pierced and rolled and made into a hollow shell as it is helically rotated.

In the above-described piercing and rolling, leaf-, fin-, or lap-shaped defects (hereinafter referred to as "inner surface defects") are generated on the inner surface of the hollow shell after the piercing and rolling because of the rotary forging effect and shear deformation.

In order to restrain such inner surface defects from being generated during the piercing and rolling, the piercing and rolling may be carried out with a smaller rolling reduction than in the conventional case. However, if the rolling reduction is reduced, the billet is less stably bitten between the inclined rolls, in other words, so-called defective biting is more likely to result.

A technique for reducing such defective biting is disclosed by JP 2000-246311 A and JP 2001-162306 A. According to the disclosure of these documents, during the period between when the tip end of a billet contacts the inclined rolls and when the billet is bitten between the inclined rolls and stably pierced, the pusher device continues to push the billet from behind. In this way, the defective biting can be restrained. Hereinafter, such piercing and rolling will be referred to as "pusher piercing and rolling."

The pusher piercing and rolling can indeed restrain the defective biting. However, when the pusher piercing and rolling is carried out, the hollow shell can have wall thickness deviation in some cases. Wall thickness deviation is particularly likely to happen at the tip end of the hollow shell that is pierced and rolled while being pushed by the pusher device.

DISCLOSURE OF THE INVENTION

It is an object of the invention to provide a pusher device capable of restraining wall thickness deviation at the tip end of a hollow shell produced by the pusher piercing and rolling and a method of manufacturing a seamless pipe or tube using the device.

The inventors have examined about the cause of wall thickness deviation generated at the tip end of a hollow shell produced by the pusher piercing and rolling. They have found as a result that during the pusher piercing and rolling, the pusher mandrel of the pusher device eccentrically rotates in the circumferential direction when the billet is engaged between the inclined rolls.

The eccentric rotation of the pusher mandrel propagates to the billet in the process of piercing and rolling and therefore the billet also eccentrically rotates. This is presumably how the tip end of the hollow shell pierced and rolled as it is pushed by the pusher device has the wall thickness deviation and bending.

One approach to restrain the eccentric rotation of the pusher mandrel is to keep the shaft center of the billet aligned with the shaft center of the pusher mandrel. However, the cross sectional shape of a billet is not exactly a regular circle. The outer diameter of the billet is not always constant and has some variation in the lengthwise direction. Therefore, during the pusher piercing and rolling, it would be difficult to keep the shaft center of the billet aligned with the shaft center of the pusher mandrel.

Therefore, the inventors have studied about a method of restraining the eccentric rotation of the pusher mandrel even if the shaft center of the billet is shifted from the shaft center of the pusher mandrel. More specifically, they have focused on the cross sectional area Sp ($mm^2$) of the pusher mandrel, the cross sectional area Sb ($mm^2$) of the billet, the length Lp (mm) of the pusher mandrel, the moving distance Lc (mm) of the tip end of the cylinder shaft during piercing and rolling, and the outer diameter Dc (mm) of the cylinder shaft. Then, the inventors conducted pusher piercing and rolling while these values were varied, and examined the wall thickness deviation at the tip ends of the obtained hollow shells. As a result, the inventors have found that the wall thickness deviation of a hollow shell can be restrained when the following Expressions (1) to (3) are satisfied in the pusher device.

$$0.3 \leqq Sp/Sb \quad (1)$$

$$Lp/Sp \leqq 1.2 \quad (2)$$

$$Lc/Dc \leqq 45 \quad (3)$$

The invention made based on the foregoing findings can be summarized as follows.

A pusher device according to the invention is a pusher device for piercing and rolling provided on the inlet side of a piercing mill that pierces and rolls a billet. The pusher device according to the invention includes a cylinder device including a cylinder shaft, and a rod shaped pusher mandrel attached at a tip end of the cylinder shaft and having its tip end abutted against the rear end of the billet. The cross sectional area Sp of the pusher mandrel and the cross sectional area Sb of the billet satisfy Expression (1). The length Lp of the pusher mandrel and the cross sectional area Sp of the pusher mandrel satisfy Expression (2). The moving distance Lc of the tip end of the cylinder shaft during piercing and rolling and the outer diameter Dc of the cylinder shaft satisfy Expression (3).

$$0.3 \leqq Sp/Sb \quad (1)$$

$$Lp/Sp \leqq 1.2 \quad (2)$$

$$Lc/Dc \leqq 45 \quad (3)$$

Herein, the moving distance Lc means the moving distance until the tip end of the cylinder shaft stops advancing after the cylinder device is driven and the tip end of the cylinder shaft starts to advance.

The pusher device according to the invention can restrain the wall thickness deviation at the tip end of the hollow shell produced by pusher piercing and rolling when Expressions (1) to (3) are satisfied.

The tip end of the pusher mandrel preferably has an outward rounded shape.

In this way, the contact area between the tip end of the pusher mandrel and the rear end of the billet is small. Therefore, friction force generated by the contact of the pusher mandrel and the billet is reduced, which restrains the eccentric rotation of the pusher mandrel. Consequently, the wall thickness deviation at the tip end of the hollow shell is reduced.

The pusher mandrel preferably includes a rod-shaped mandrel main body member and a mandrel tip end member. The mandrel tip end member is attached rotatably in the circumferential direction at an end of the mandrel main body member. The tip end of the mandrel tip end member is abutted against the rear end of the billet.

In this way, when the billet engaged between the inclined rolls rotates in the circumferential direction, the mandrel tip end member readily rotates in the same rotation direction as the rotation direction of the billet and substantially at the same rotation speed. Therefore, the friction force attributable to the difference between the rotation speed of the billet and the rotation speed of the pusher mandrel can be reduced.

By a method of manufacturing a seamless pipe according to invention, a billet is pierced and rolled using a piercing mill including a plurality of inclined rolls and the above-described pusher device provided on the inlet side of the piercing mill. The method of manufacturing a seamless pipe according to the invention includes the steps of providing the billet between the pusher device and the piercing mill, pushing the rear end of the billet by the pusher device, thereby having the tip end of the billet bitten between the inclined rolls, and pushing the billet forward by the pusher device until the tip end of the billet moves for a prescribed distance after the tip end of the billet is bitten.

Preferably, in the step of pushing the billet forward, the billet is pushed forward using the pusher device at least during the period after the tip end of the billet is bitten between the inclined rolls until the piercing and rolling attains a steady state. Herein, the steady state refers to the state during the period between when the tip end of the pierced and rolled billet (i.e., the tip end of the hollow shell) moves out from between the rear ends of the inclined rolls and when the rear end of the billet touches the inclined rolls.

In this way, the defective biting of the billet can be restrained and the wall thickness deviation at the tip end of the hollow shell can be reduced.

BEST MODE FOR CARRYING OUT THE INVENTION

Figure 1:
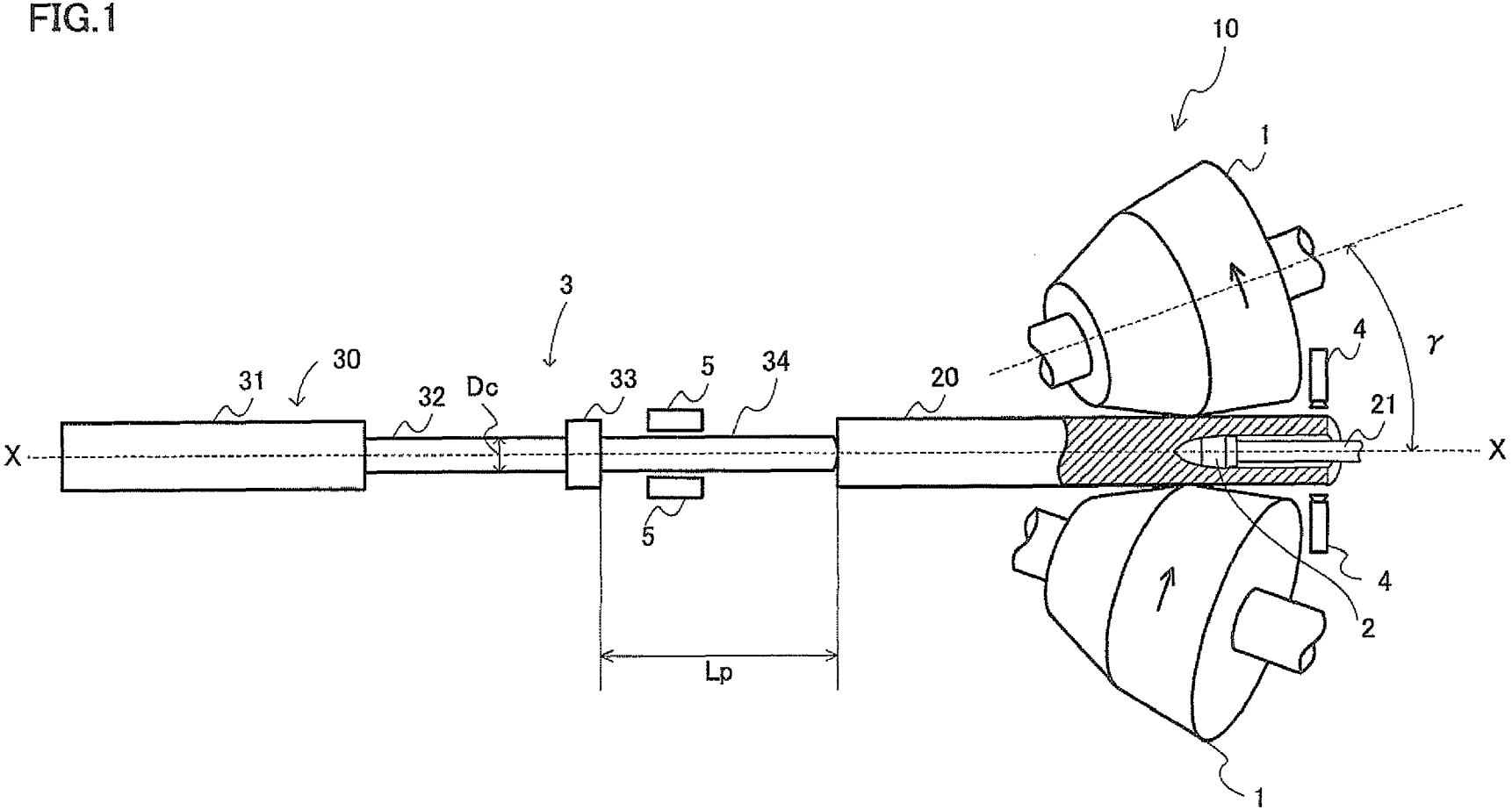
FIG. 1 is a top view of the general structure of a piercing mill and a pusher device according to a first embodiment of the invention.

Now, embodiments of the invention will be described in detail in conjunction with the accompanying drawings in which the same or corresponding portions are denoted by the same reference characters and their description will not be repeated.

1. First Embodiment

General Structure of Piercing Mill

Figure 2:
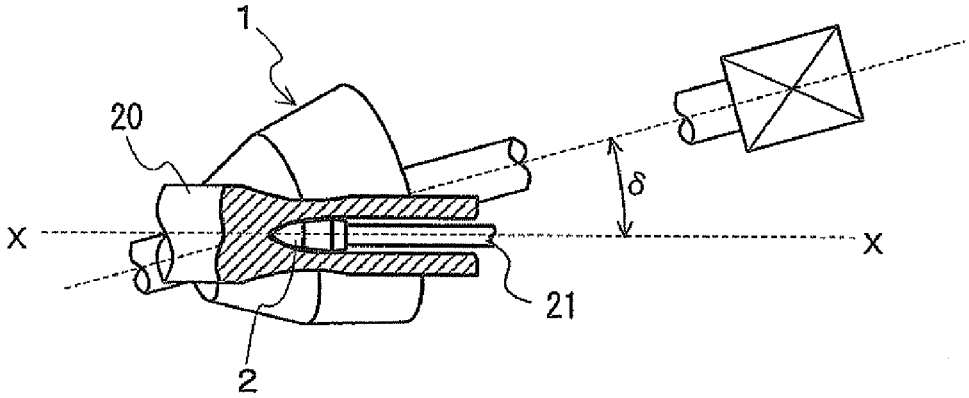
FIG. 2 is a side view of the piercing mill shown in FIG. 1.

With reference to FIGS. 1 and 2, a piercing mill 10 includes two cone type inclined rolls (hereinafter simply as "inclined rolls") 1 and a plug 2. A pusher device 3 is provided on the inlet side of the piercing mill 10 and a plurality of HMDs (Hot Metal Detectors) 4 are provided on the outlet side of the piercing mill 10. A trough or a plurality of transport rollers to transport a billet 20 are provided on the pass line X-X between the piercing mill 10 and the pusher device 3 though not shown.

The two inclined rolls 1 are provided to be opposed to each other with the pass line X-X therebetween. The inclined rolls 1 have an inclination angle $\delta$ and a crossed axes angle $\gamma$ with respect to the pass line X-X. The plug 2 is provided between the two inclined rolls 1 and on the pass line X-X and has its rear end connected to the tip end of a plug mandrel 21.

The two HMDs 4 as detectors are provided on the outlet side of the piercing mill 10 and near the rear end of the inclined rolls 1. The HMDs 4 detect whether the tip end of a hollow shell pierced and rolled has passed between the inclined rolls 1. Based on the detection result by the HMDs 4, the pusher device 3 can push the billet 20 until the tip end of the hollow shell passes between the inclined rolls 1 and stop pushing the billet 20 after the tip end of the hollow shell passes between the inclined rolls 1.

Structure of Pusher Device

The pusher device 3 is provided in front of the inlet side of the piercing mill 10 and along the pass line X-X. The pusher device 3 includes a cylinder device 30, a connection member 33, and a pusher mandrel 34. The cylinder device 30 includes a cylinder main body 31, and a cylinder shaft 32. The cylinder device 30 is a hydraulic or electromotive type device and advances/withdraws the cylinder shaft 32. The cylinder shaft 32 is a solid round rod member and has a circular cross section.

The pusher mandrel 34 has a rod shape. The cross sectional shape of the pusher mandrel 34 is for example circular or annular. More specifically, the pusher mandrel 34 may be a solid rod member or a hollow rod member. The pusher mandrel 34 is connected with the cylinder shaft 32 by the connection member 33, so that it can rotate in the circumferential direction.

The pusher device 3 has the tip end of the pusher mandrel 34 abutted against the rear end of the billet 20 and thus advances the cylinder shaft 32 and the pusher mandrel 34. In this way, the pusher device 3 pushes the billet 20 from behind.

The process of piercing and rolling using the pusher device 3 is as follows. The billet 20 is provided on the pass line X-X between the piercing mill 10 and the pusher device 3. Then, the pusher device 3 pushes the billet 20 forward toward the piercing mill 10. In this way, the billet 20 is bitten between the inclined rolls 1. At the time, the pusher device 3 further advances the billet 20 until the tip end of the billet 20 (i.e., the tip end of the hollow shell) moves for a prescribed distance.

Preferably, the pusher device 3 continues to push the rear end of the billet 20 after the tip end of the billet 20 is bitten between the inclined rolls until the tip end of the pierced and rolled billet 20 moves out from between the rear ends of the inclined rolls, in other words, until the piercing and rolling attains a steady state. At the time, the moving speed of the pusher mandrel 34 is preferably not less than the advancing speed of the billet 20 in the piercing and rolling direction.

In this way, in the pusher piercing and rolling, the piercing and rolling is carried out while the billet 20 is pushed by the pusher device 3, so that the defective biting of the billet 20 can be restrained.

In the pusher device 3, the following Expressions (1) to (3) are satisfied by the cross sectional area Sb ($mm^2$) of the billet 20 (i.e., the section of the billet 20 orthogonal to the lengthwise direction), the cross sectional area Sp ($mm^2$) of the pusher mandrel 34 (i.e., the cross section of the pusher mandrel 34 orthogonal to the lengthwise direction), the length Lp (mm) of the pusher mandrel 34, the outer diameter Dc (mm) of the cylinder shaft 32, and the moving distance Lc (mm) of the tip end of the cylinder shaft during the pusher piercing and rolling.

$$0.3 \leqq Sp/Sb \quad (1)$$

$$Lp/Sp \leqq 1.2 \quad (2)$$

$$Lc/Dc \leqq 45 \quad (3)$$

The pusher device 3 restrains the wall thickness deviation of a hollow shell during the above-described pusher piercing and rolling when Expressions (1) to (3) are satisfied. Now, Expressions (1) to (3) will be described in detail.

Expression (1)

The cross sectional area Sp of the pusher mandrel 34 in Expression (1) is obtained by the following method. Cross sectional areas are obtained in arbitrary 10 positions of the pusher mandrel 34. The average of the obtained 10 cross sectional areas is defined as Sp. The cross sectional area Sb of the billet 20 is obtained by the following method. Cross sectional areas are obtained in arbitrary 10 positions of the billet 20. The average of the obtained 10 cross sectional areas is defined as Sb.

Note that when the pusher mandrel 34 is a hollow member, its cross sectional shape is annular, and the area of the annular shape is obtained as the cross sectional area.

The wall thickness deviation of the hollow shell can be improved as Expression (1) is satisfied. Although the reason is not exactly clear, it is probably because of the following aspect. More specifically, as Expression (1) is satisfied, the pusher mandrel is less likely to eccentrically rotate during the pusher piercing and rolling. This reduces the eccentric rotation of the billet, which restrains the wall thickness deviation of the hollow shell.

Figure 3:
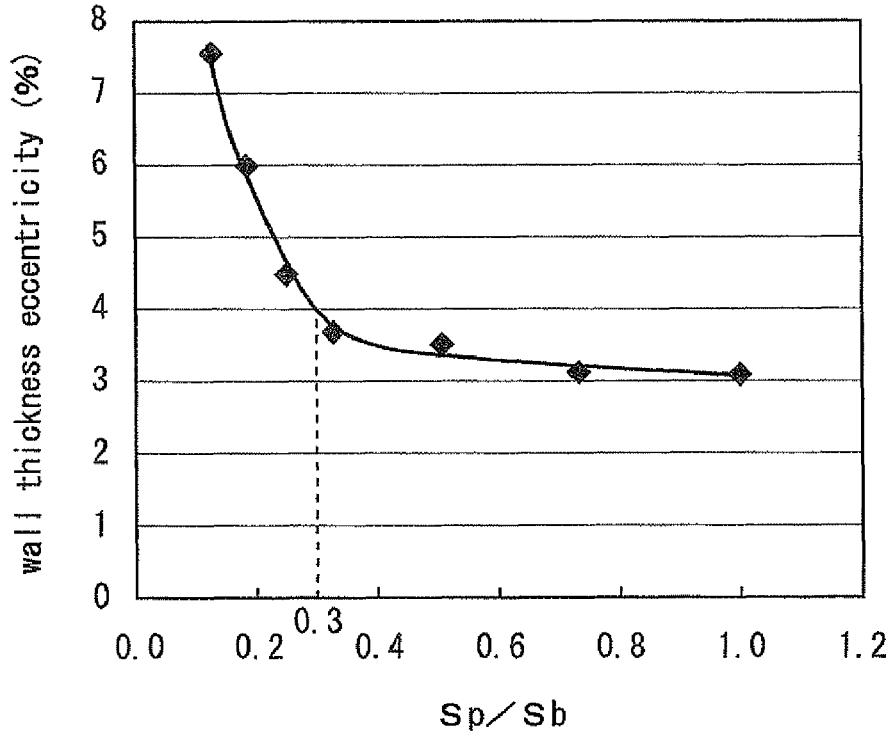
FIG. 3 is a graph showing the relation between the cross sectional area Sp of the pusher mandrel shown in FIG. 1 and the cross sectional area Sb of a billet and the wall thickness eccentricity of a hollow shell produced by pusher piercing and rolling.

FIG. 3 shows the relation between Sp/Sb and the wall thickness deviation of the hollow shell. The graph in FIG. 3 was obtained by the following tests.

A plurality of round billets having an outer diameter of 70 mm and a cross sectional area Sb of 3846.5 $mm^2$ were prepared. These prepared billets are each made of carbon steel having a carbon content of 0.45% by mass. In the conditions in Table 1, the billets were subjected to pusher piercing and rolling and hollow shells were produced.

TABLE 1

| | |
|---|---|
| crossed axes angle (°) | 10 |
| inclination angle (°) | 10 |
| round billet outer diameter (mm) | 70 |
| Dc (mm) | 70 |
| Lc (mm) | 860 |

With reference to Table 1, Lc and Dc were fixed, and Expression (3) was satisfied. A plurality of pusher mandrels having different pusher mandrel lengths Lp (mm) and cross sectional areas Sp ($mm^2$) among one another were prepared. For each of the plurality of pusher mandrels, Lp/Sp=1.0, which satisfied Expression (2). Each of the pusher mandrels was a hollow rod member having an annular cross section.

The hollow shells produced in the above-described conditions were examined for their wall thickness deviations at the tip ends. More specifically, measurement positions were determined at a pitch of 10 mm from the tip end of each of the hollow shells (that corresponds to the end pierced first between the two ends of the billet) to the position 150 mm apart in the lengthwise direction. The wall thickness was measured at eight positions at equal intervals in the circumferential direction at the cross section in each of the measurement positions. Based on the measured wall thicknesses, the wall thickness eccentricity at each of the measurement positions was calculated according to Expression (4):

$$\text{Wall thickness eccentricity at each measurement position} = (T\max - T\min)/T\text{ave} \times 100(\%) \quad (4)$$

where Tmax represents the maximum wall thickness among the plurality of wall thicknesses measured at the eight positions, Tmin represents the minimum wall thickness among the wall thicknesses measured at the eight positions, and Tave is the average of the wall thicknesses measured at the eight positions. The wall thickness eccentricity (%) of each of the billets is defined as the average of the obtained wall thickness eccentricities at the measurement positions.

The cross sectional areas Sp of the pusher mandrels were obtained by the following method. Cross sectional areas were obtained in arbitrary 10 positions of each of the used pusher mandrels. The average of the obtained cross sectional areas was defined as Sp. The cross sectional areas Sb of a billet were obtained by the following method. Cross sectional areas were obtained in arbitrary 10 positions of a billet to be pierced and rolled. The average of the obtained cross sectional areas was defined as Sb.

With reference to FIG. 3, as Sp/Sb increases, the wall thickness eccentricity is lowered. The inclination of the curve greatly changes at the point where Sp/Sb=0.3. More specifically, until Sp/Sb increases and equals 0.3, the wall thickness eccentricity sharply decreases. As a result, where Sp/Sb=0.3, the wall thickness eccentricity was dropped to less than 4.5%. Meanwhile, when Sp/Sb is greater than 0.3, the degree of decrease of the wall thickness eccentricity becomes gentle. Therefore, Sp/Sb is not less than 0.3.

Note that if Sp/Sb increases, the cross sectional area of the pusher mandrel 34 increases and therefore the pusher device 3 as a whole must be increased in size. The increase in the size of the pusher device results in increase in the installment cost. Therefore, the upper limit for Sp/Sb is preferably 1.0. Note however if Sp/Sb exceeds 1.0, the effect of the invention can still be provided.

Figure 4:
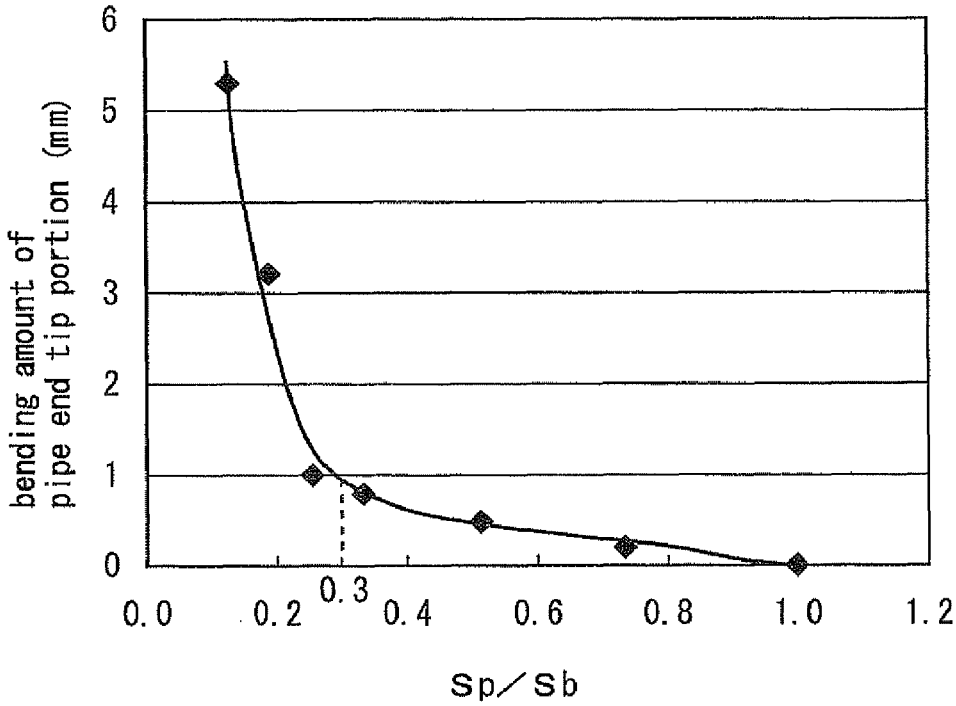
FIG. 4 is a graph showing the relation between the cross sectional area Sp of the pusher mandrel shown in FIG. 1 and the cross sectional area Sb of a billet and the bending amount of a hollow shell produced by pusher piercing and rolling.

FIG. 4 shows the relation between Sp/Sb and the bending amount of the tip end of the hollow shell. FIG. 4 shows the result of measurement of the bending amount (mm) of each of the hollow shells obtained by the same tests as those in FIG. 3. The bending amount of each of the hollow shells was obtained as follows. In the range of 200 mm from the tip end of the hollow shell, a straight steel scale was placed on the surface of the hollow shell and the gap between the steel scale and the surface of the hollow shell was measured in the circumferential direction. The maximum value of the measured gaps was defined as the bending amount.

With reference to FIG. 4, the bending amount of the hollow shell has the same tendency as that of the wall thickness deviation. More specifically, when Sp/Sb is not more than 0.3 and Sp/Sb increases, the bending amount sharply decreases. The bending amount is less than 1 mm when Sp/Sb=0.3. Meanwhile, after Sp/Sb exceeds 0.3, the bending amount mildly decreases.

As can be understood from the above-described result, the wall thickness deviation and the bending amount of the hollow shell can be reduced when Sp/Sb is not less than 0.3. More specifically, in this way, the wall thickness eccentricity of the tip end of the hollow shell can be less than 4.5% and the bending amount can be less than 1 mm.

Note that in the foregoing description, the pusher mandrel 34 has a circular or annular cross section, while it may have a different shape. For example, the pusher mandrel 34 may be a solid rod member having a rectangular or polygonal cross section, or a hollow rod member having a rectangular or polygonal cross section. With any of these shapes, the wall thickness deviation and bending of the hollow shell can be reduced as long as Expression (1) is satisfied.

Expression (2)

The wall thickness deviation of the hollow shell is reduced by setting Lp/Sp to 1.2 or less in addition to satisfying Expression (1). Although the reason is not exactly clear, it is probably because the eccentric rotation of the pusher mandrel is restrained during the pusher piercing and rolling when Expression (2) is satisfied.

Figure 5:
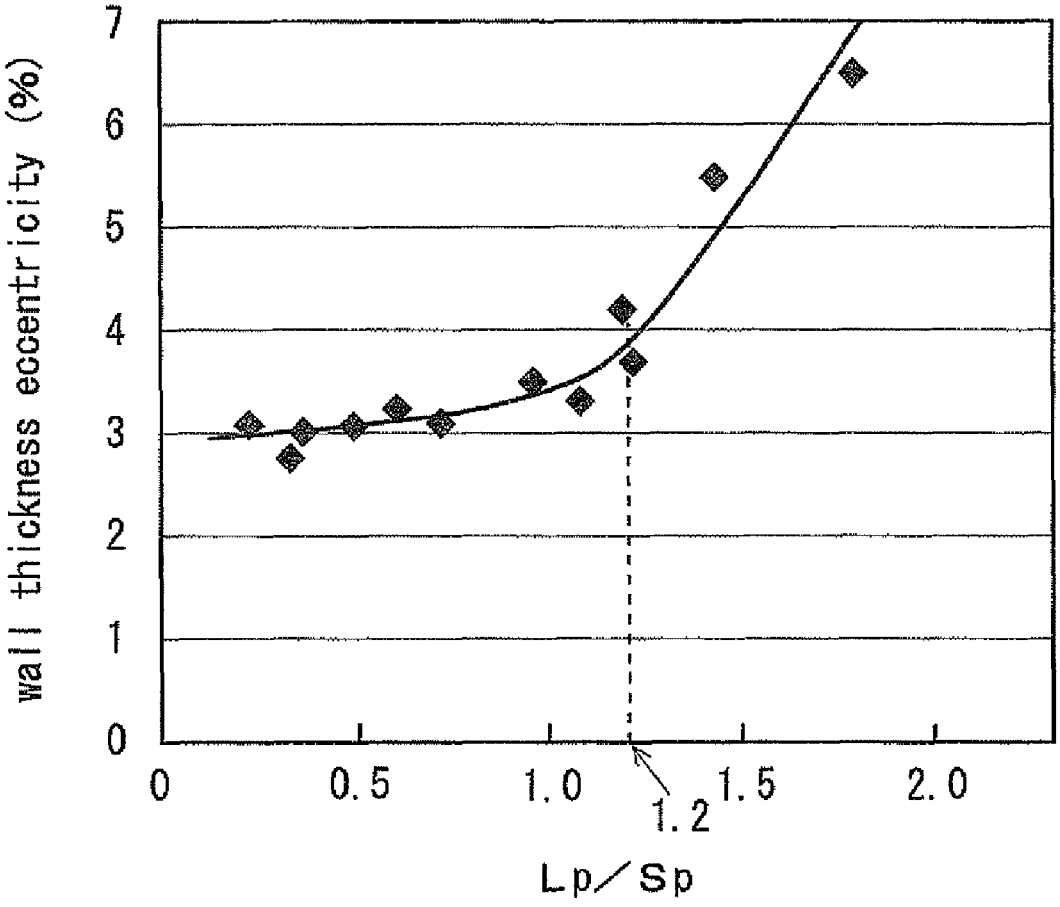
FIG. 5 is a graph showing the relation between the length Lp and the cross sectional area Sp of the pusher mandrel shown in FIG. 1 and the wall thickness eccentricity of a hollow shell produced by pusher piercing and rolling.

FIG. 5 shows the relation between Lp/Sp and the wall thickness deviation of the hollow shell. The graph in FIG. 5 was obtained by the following test method.

A plurality of billets having the same sizes as those in the tests in FIG. 3 were prepared. Furthermore, a plurality of hollow pusher mandrels having an annular cross sectional shape, a cross sectional area Sp of 1963 $mm^2$, and different lengths Lp among one another were prepared. The prepared pusher mandrels were each mounted to the pusher device and pusher piercing and rolling was carried out in the conditions shown in Table 1. At the time, Sp/Sb=0.51 and Expression (1) was satisfied. Expression (3) was also satisfied. The wall thickness eccentricity (%) of each of the produced hollow shells was obtained by the same method as in the tests in FIG. 3.

With reference to FIG. 5, as Lp/Sp decreases, the wall thickness eccentricity decreases. The inclination of the curve changes after the point where Lp/Sp=1.2. More specifically, until Lp/Sp is reduced to 1.2, the wall thickness eccentricity sharply decreases and become less than 4.5%. Meanwhile, when Lp/Sp is 1.2 or less, the degree of decrease in the wall thickness eccentricity becomes gentle. Therefore, Lp/Sp is not more than 1.2.

Expression (3)

Similarly to Expressions (1) and (2), the wall thickness deviation of the hollow shell is reduced when Expression (3) is satisfied. It is probably for the following reasons. As the moving distance Lc of the tip end of the cylinder shaft 32 during the pusher piercing and rolling increases, the length of the cylinder shaft 32 pushed out from the cylinder main body 31 increases. As the length of the cylinder shaft 32 pushed out from the cylinder main body 31 is larger, the cylinder shaft 32 is more easily flexed. This is because the cylinder shaft 32 is pushed by the cylinder main body as well as by the billet 20 bitten between the inclined rolls 1. It is presumed that if the cylinder shaft 32 is flexed, the cylinder shaft 32 is more likely to eccentrically rotate, so that the wall thickness of the hollow shell would more easily deviate.

When Lc/Dc exceeds 45, the wall thickness eccentricity of the hollow shell increases, specifically to 4.5% or more. Therefore, Lc/Dc is not more than 45.

As shown in FIG. 1, the tip end of the pusher mandrel 34 has an outward rounded shape. Since the tip end is rounded, the contact area between the tip end of the pusher mandrel 34 and the rear end of the billet 20 is small. Therefore, the friction force caused by the contact between the pusher mandrel 34 and the billet 20 can be reduced. If the friction force is small, the eccentric rotation of the pusher mandrel 34 is restrained, so that the wall thickness deviation of the hollow shell is more restrained. Note that if the tip end of the pusher mandrel 34 is flat, the effect of the invention can be obtained as long as Expressions (1) to (3) are satisfied.

As shown in FIG. 1, two mandrel guide members 5 are provided opposed to each other with the pusher mandrel 34 therebetween. There is a certain gap between each of the mandrel guide member 5 and the pusher mandrel 34. The mandrel guide member 5 restrains the pusher mandrel 34 from being eccentrically rotated and shifted from the pass line X-X. The mandrel guide member 5 does not have to be provided while the mandrel guide member 5 can restrain the eccentric rotation of the pusher mandrel 34 to some extent.

The materials of the pusher mandrel 34 and the cylinder shaft 32 are not specifically limited and may be any metal materials having a large Young's modulus.

2. Second Embodiment

Figure 6:
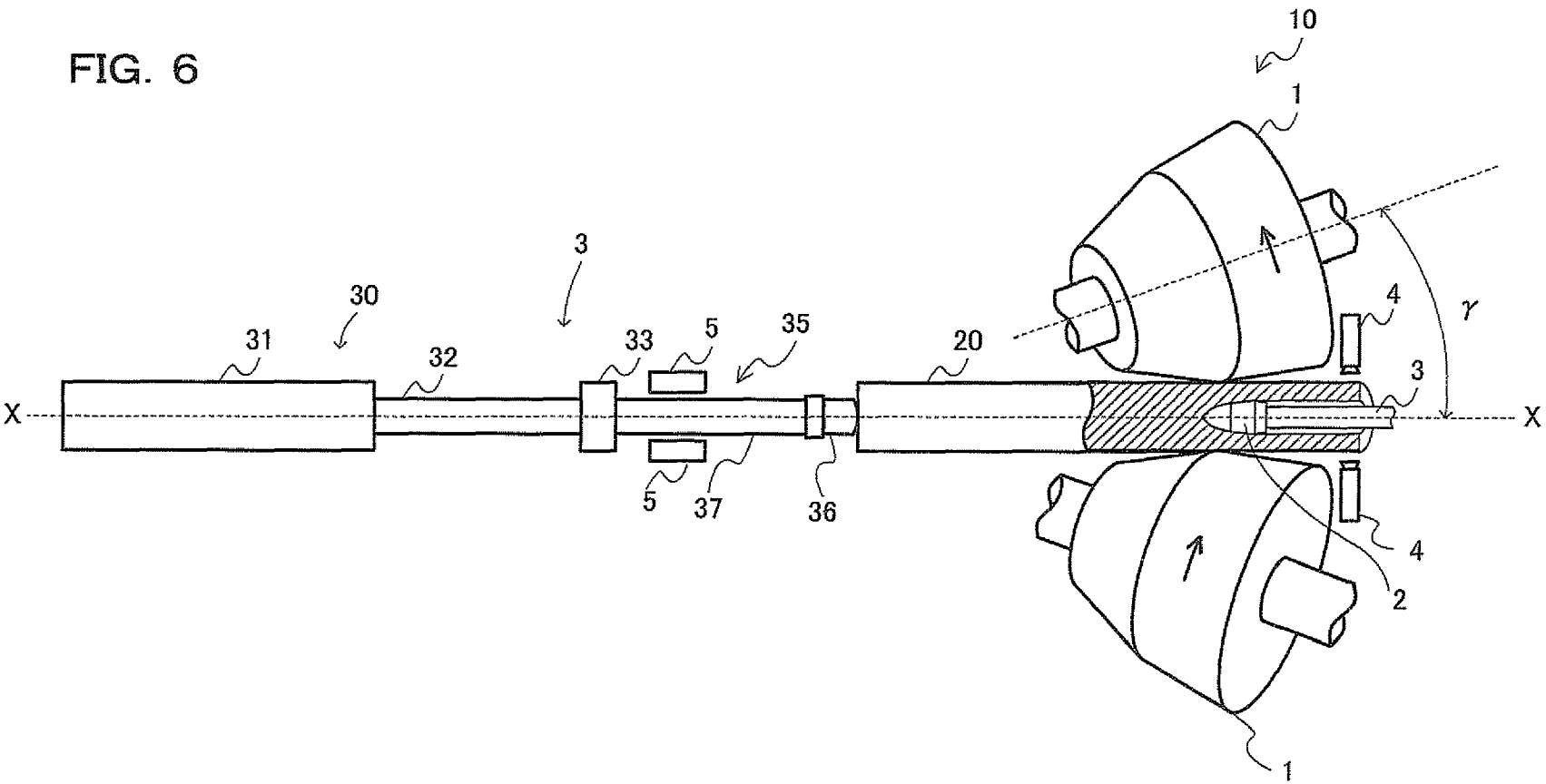
FIG. 6 is a top view of the general structure of a piercing mill and a pusher device according to a second embodiment of the invention.

A pusher mandrel may include a plurality of members. With reference to FIG. 6, a pusher device 3 according to a second embodiment includes a pusher mandrel 35 instead of the pusher mandrel 34.

The pusher mandrel 35 includes a mandrel tip end member 36 and a mandrel main body member 37. The length of the mandrel tip end member 36 is shorter than that of the mandrel main body member 37.

Figure 7:
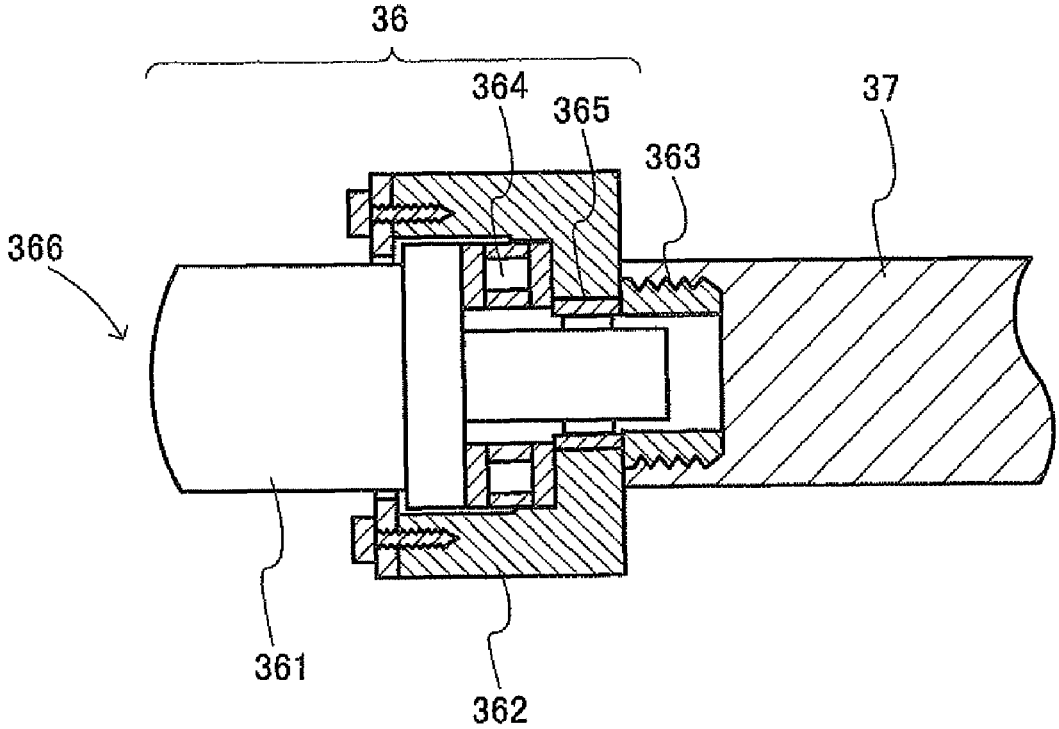
FIG. 7 is a longitudinal sectional view of the mandrel tip end member shown in FIG. 6.

With reference to FIG. 7, the mandrel tip end member 36 includes a tip end portion 361, a pivotal portion 362, and a connection portion 363. The pivotal portion 362 stores a thrust roller bearing 364 and a needle bearing 365. The pivotal portion 362 holds the tip end portion 361 rotatably in the circumferential direction by the thrust roller bearing 364 and the needle bearing 365. The connection portion 363 has a male screw and is attached to the mandrel main body member 37 having a female screw at the tip end. In this way, the mandrel tip end member 36 is fixed to the mandrel main body ember 37.

The pusher mandrel 34 shown in FIG. 1 is connected rotatably in the circumferential direction by the connection member 33. Therefore, during pusher piercing and rolling, when a billet 20 bitten between the inclined rolls 1 starts to rotate in the circumferential direction, the pusher mandrel 34 in contact with the billet 20 also rotates in the circumferential direction.

However, if the pusher mandrel 34 has a large weight, it does not easily rotate in the circumferential direction and the rotation speed can be different from the rotation speed of the billet 20. In such a case, friction force is generated between the rear end of the billet 20 and the tip end of the pusher mandrel 34. The friction force causes the pusher mandrel 34 to eccentrically rotate and the hollow shell to have wall thickness deviation.

On the other hand, the pusher mandrel 35 according to the embodiment includes the mandrel tip end member 36 and the mandrel main body member 37, and the mandrel tip end member 36 is attached to the mandrel main body member 37 rotatably in the circumferential direction. The mandrel tip end member 36 is naturally lighter in weight than the entire pusher mandrel 35. Therefore, when the billet 20 bitten between the inclined rolls 1 rotates in the circumferential direction, the mandrel tip end member 36 can easily rotate substantially at the same rotation speed and in the same direction as the billet. Therefore, the friction force attributable to the difference in the rotation speed can be restrained, and the wall thickness deviation of the hollow shell can be reduced.

Furthermore, as shown in FIG. 7, the tip end 366 of the mandrel tip end portion 361 has an outward rounded shape. Therefore, the friction force generated when the pusher mandrel 34 abuts against the billet 20 can be reduced. Note that the tip end 366 may be flat rather than the outward rounded shape and the above-described effect can still be obtained to some extent.

EXAMPLES

Pusher piercing and rolling was carried out while the billet cross sectional area Sb, the pusher mandrel cross sectional area Sp, the pusher mandrel length Lp, the cylinder shaft outer diameter Dc, and the moving distance Lc of the tip end of the cylinder shaft were set to the conditions 1 to 8 in Table 2. After the pusher piercing and rolling, the tip ends of the produced hollow shells were examined for their wall thickness deviations.

TABLE 2

| condition No. | Sp ($mm^2$) | Sb ($mm^2$) | Sp/Sb | Lp (mm) | Lp/Sp | Lc (mm) | Dc (mm) | Lc/Dc | wall thickness eccentricity (%) |
|---|---|---|---|---|---|---|---|---|---|
| 1 | 616 | 3847 | 0.16 | 600 | 0.974 | 860 | 28 | 31 | 4.5 |
| 2 | 491 | 3847 | 0.13 | 1200 | 2.444 | 1260 | 25 | 50 | 6.5 |
| 3 | 1257 | 3847 | 0.33 | 1900 | 1.511 | 860 | 70 | 12 | 4.9 |
| 4 | 3848 | 3847 | 1.00 | 1200 | 0.312 | 860 | 70 | 12 | 3.0 |
| 5 | 2827 | 3847 | 0.73 | 1500 | 0.531 | 860 | 70 | 12 | 3.1 |
| 6 | 1963 | 3847 | 0.51 | 1500 | 0.764 | 860 | 70 | 12 | 3.3 |
| 7 | 1257 | 3847 | 0.33 | 1500 | 1.193 | 860 | 70 | 12 | 3.2 |
| 8 | 1963 | 3847 | 0.51 | 1200 | 0.611 | 1260 | 28 | 45 | 4.3 |

The plurality of round billets prepared were made of carbon steel having a carbon content of 0.45%. Note that the pusher mandrel was a cylindrical hollow member. The tip end of the pusher mandrel was flat. The pusher mandrel cross sectional areas Sp ($mm^2$) in Table 2 were obtained by the following method. Cross sectional areas in arbitrary 10 positions of a pusher mandrel with each condition No. were obtained and the average of the 10 cross sectional areas was defined as Sp. The billet cross sectional areas Sb ($mm^2$) in Table 2 were obtained by the following method. Cross sectional areas in arbitrary 10 positions of a billet with each condition No. were obtained and the average of the obtained 10 cross sectional areas was defined as Sb.

The wall thickness eccentricity (%) of the hollow shells produced in condition Nos. 1 to 8 were obtained by the following method. Measurement positions were determined at a pitch of 10 mm in the range of 150 mm from the tip end of each hollow shell. In a cross section in each of the measurement positions, thicknesses were measured in eight positions at equal intervals in the circumferential direction. The wall thickness eccentricity in each measurement position was calculated from the measured wall thicknesses based on Expression (4). The wall thickness eccentricity of each of the billets was produced as the average of the wall thickness eccentricities produced in the measurement positions. The obtained wall thickness eccentricities are given in Table 2.

With reference to Table 2, conditions 4 to 8 all satisfied Expressions (1) to (3). Therefore, the wall thickness eccentricities of the produced hollow shells were less than 4.5%.

On the other hand, conditions 1 to 3 each did not satisfy all of Expressions (1) to (3), and the wall thickness eccentricities were not less than 4.5%.

Although the embodiments of the present invention have been described, the same is by way of illustration and example only of how to carry out the invention and is not to be taken by way of limitation. The invention may be embodied in various modified forms without departing from the spirit and scope of the invention.

The invention claimed is:

1. A pusher device for piercing and rolling provided on the inlet side of a piercing mill piercing and rolling a billet, comprising:

a cylinder device including a cylinder shaft; and a rod shaped pusher mandrel attached at a tip end of said cylinder shaft and having its tip end abutted against the rear end of said billet, the cross sectional area Sp of said pusher mandrel and the cross sectional area Sb of said billet satisfying Expression (1), the length Lp of said pusher mandrel and the cross sectional area Sp of said pusher mandrel satisfying Expression (2), the moving distance Lc of the tip end of said cylinder shaft during piercing and rolling and the outer diameter Dc of said cylinder shaft satisfying Expression (3).

$$0.3 \leqq Sp/Sb \quad (1)$$

$$Lp/Sp \leqq 1.2 \quad (2)$$

$$Lc/Dc \leqq 45 \quad (3)$$

2. The pusher device according to claim 1, wherein the tip end of said pusher mandrel has an outward rounded shape.

3. The pusher device according to claim 1, wherein said pusher mandrel comprises:

a rod-shaped mandrel main body member; and a mandrel tip end member attached rotatably in the circumferential direction at an end of said mandrel main body member and having its tip end abutted against the rear end of said billet.

4. A method of manufacturing a seamless pipe produced by piercing and rolling a billet using a piercing mill including a plurality of inclined rolls and a pusher device provided on the inlet side of said piercing mill, said pusher device comprising:

a cylinder device including a cylinder shaft; and a rod shaped pusher mandrel attached at a tip end of said cylinder shaft and having its tip end abutted against the rear end of said billet, the cross sectional area Sp of said pusher mandrel and the cross sectional area Sb of said billet satisfying Expression (1), the length Lp of said pusher mandrel and the cross sectional area Sp of said pusher mandrel satisfying Expression (2), the moving distance Lc of the tip end of said cylinder shaft during piercing and rolling and the outer diameter Dc of said cylinder shaft satisfying Expression (3), said method of manufacturing a seamless pipe comprising the steps of:

providing said billet between said pusher device and said piercing mill;

pushing the rear end of said billet by said pusher device, thereby having the tip end of said billet bitten between said inclined rolls; and pushing said billet forward by said pusher device until the tip end of said billet moves for a prescribed distance after the tip end of said billet is bitten.

$$0.3 \leqq Sp/Sb \quad (1)$$

$$Lp/Sp \leqq 1.2 \quad (2)$$

$$Lc/Dc \leqq 45 \quad (3)$$

* * * * *